US011008719B2

(12) United States Patent
Schaedler et al.

(10) Patent No.: US 11,008,719 B2
(45) **Date of Patent: *May 18, 2021**

(54) SNOW THROWER IMPELLER

(71) Applicant: MTD Products Inc, Valley City, OH (US)

(72) Inventors: Axel Schaedler, Olmsted Township, OH (US); Peter Buchanan, Elyria, OH (US)

(73) Assignee: MTD PRODUCTS INC, Valley City, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/358,915

(22) Filed: Mar. 20, 2019

(65) Prior Publication Data

US 2019/0218733 A1 Jul. 18, 2019

Related U.S. Application Data

(63) Continuation of application No. 15/544,577, filed as application No. PCT/US2016/015111 on Jan. 27, 2016, now Pat. No. 10,407,856.

(Continued)

(51) Int. Cl.
*E01H 5/04* (2006.01)
*F04D 7/04* (2006.01)

(Continued)

(52) U.S. Cl.
CPC ..... *E01H 5/045* (2013.01); *E01H 5/09* (2013.01); *F04D 7/04* (2013.01); *F04D 31/00* (2013.01)

(58) Field of Classification Search
CPC .. E01H 5/04; E01H 5/045; E01H 5/09; E01H 5/092; E01H 5/094; E01H 5/096; E01H 5/098; E01H 5/066
See application file for complete search history.

(56) References Cited

U.S. PATENT DOCUMENTS 2,104,881 A 1/1938 Mclemore
2,151,491 A 3/1939 Washburn (Continued)

FOREIGN PATENT DOCUMENTS

CA 1 200 259 A 2/1986
CA 2 273 704 C 2/2004

(Continued)

OTHER PUBLICATIONS

Advertisement for Snow Blower Impeller Kit, SnowBlowerImpellerKit.com, 2012.

(Continued)

*Primary Examiner* — Jamie L McGowan
(74) *Attorney, Agent, or Firm* — Wegman Hessler

(57) ABSTRACT

A snow thrower impeller assembly (24) includes a mounting slot (84) for a wiper (70). The wiper includes a wiper portion (86) that slides into the mounting slot to mount the wiper to the impeller (54). The wiper contacts an interior wall (56) of an associated impeller housing during rotational operation of the impeller in order to limit a gap (74) between an impeller blade (66) and the interior wall. The wiper can move radially inward and outward to remain in contact with the interior wall without input from the operator. Another embodiment of the impeller assembly includes impeller blades with a first portion (116) and a second portion (118). The second portion extends at a non-zero angle from the first blade portion of the impeller blade.

12 Claims, 11 Drawing Sheets

Related U.S. Application Data

(60) Provisional application No. 62/108,116, filed on Jan. 27, 2015.

(51) Int. Cl.
*F04D 31/00* (2006.01)
*E01H 5/09* (2006.01)

(56) References Cited

U.S. PATENT DOCUMENTS

| | | | |
|---|---|---|---|
| 2,192,802 | A | 3/1940 | Pound |
| 2,281,289 | A | 4/1942 | Hewitt |
| 2,318,881 | A | 5/1943 | Mundy |
| 2,715,246 | A | 8/1955 | Van Doom |
| 2,775,991 | A | 1/1957 | Elliott |
| 2,903,302 | A | 9/1959 | Ross |
| 2,984,872 | A | 5/1961 | France |
| 3,032,169 | A | 5/1962 | Bridgewater |
| 3,045,840 | A | 7/1962 | Donelson, Jr. |
| 3,061,480 | A | 10/1962 | Zink |
| 3,151,784 | A | 10/1964 | Tailor |
| 3,239,954 | A | 3/1966 | Brier |
| 3,303,588 | A | 2/1967 | Krause |
| 3,367,521 | A | 2/1968 | Seymour et al. |
| 3,515,258 | A | 6/1970 | Wolfe et al. |
| 3,556,355 | A | 1/1971 | Ruiz |
| 3,589,500 | A | 6/1971 | Hansen |
| 3,775,878 | A | 12/1973 | Beckner |
| 3,805,421 | A | 4/1974 | Kamlukin et al. |
| 3,895,745 | A | 7/1975 | Hook |
| 3,913,247 | A | 10/1975 | Ruhl |
| 3,936,979 | A | 2/1976 | Fuerst |
| 3,982,337 | A | 9/1976 | Garriott |
| 4,138,829 | A | 2/1979 | Chase |
| 4,155,486 | A | 5/1979 | Brown |
| 4,203,237 | A | 5/1980 | Enters et al. |
| 4,231,495 | A | 11/1980 | Lund |
| 4,235,293 | A | 11/1980 | Ellis |
| 4,295,285 | A | 10/1981 | Stevens |
| 4,322,896 | A | 4/1982 | Miyazawa et al. |
| 4,325,195 | A | 4/1982 | Comer |
| 4,360,983 | A | 11/1982 | Krug |
| 4,425,058 | A | 1/1984 | Sorensen et al. |
| 4,536,121 | A | 8/1985 | Stewart et al. |
| 4,694,594 | A | 9/1987 | Thorud et al. |
| 4,711,073 | A | 12/1987 | Freier, Jr. et al. |
| 4,725,005 | A | 2/1988 | Wiegelmann |
| 4,899,471 | A | 2/1990 | Sasaki et al. |
| 4,908,968 | A | 3/1990 | Thorud et al. |
| 4,916,837 | A | 4/1990 | Olmr et al. |
| 4,928,409 | A | 5/1990 | Mantingh |
| 4,930,944 | A | 6/1990 | vanGinhoven |
| 4,951,403 | A | 8/1990 | Olmr |
| 4,972,665 | A | 11/1990 | Hicks |
| RE33,726 | E | 10/1991 | Thorud et al. |
| D325,034 | S | 3/1992 | Buschbom |
| 5,190,140 | A | 3/1993 | Buschbom |
| 5,398,431 | A | 3/1995 | Beihoffer et al. |
| 5,707,017 | A | 1/1998 | Paolucci et al. |
| 5,758,436 | A | 6/1998 | Harms |
| 5,966,846 | A | 10/1999 | Harms et al. |
| 6,327,798 | B1 | 12/2001 | Sakai et al. |
| 6,470,602 | B2 | 10/2002 | White, III et al. |
| 6,539,649 | B2 | 4/2003 | Sueshige et al. |
| 6,764,390 | B2 | 7/2004 | Holloway et al. |
| 6,865,826 | B1 | 3/2005 | Lakin |
| 7,121,021 | B2 | 10/2006 | Sakai |
| 7,174,660 | B2 | 2/2007 | Sakai |
| 7,257,909 | B2 | 8/2007 | Shaffer et al. |
| 7,354,466 | B2 | 4/2008 | Dunning et al. |
| 7,412,786 | B1 | 8/2008 | Stewart |
| 7,597,219 | B2 | 10/2009 | O'Leary et al. |
| 7,905,035 | B2 | 3/2011 | Thomas |
| 7,971,814 | B2 | 7/2011 | Evans et al. |
| 8,402,680 | B2 | 3/2013 | Steinike et al. |
| 8,506,017 | B2 | 8/2013 | Southern |
| 8,602,334 | B2 | 12/2013 | Svoboda et al. |
| 9,279,222 | B2 | 3/2016 | Gerrits |
| 2008/0292455 | A1 | 11/2008 | Glore et al. |
| 2013/0216417 | A1 | 8/2013 | Dixon et al. |
| 2014/0068976 | A1 | 3/2014 | Mast et al. |
| 2014/0150302 | A1 | 6/2014 | Mast et al. |
| 2014/0237864 | A1 | 8/2014 | Gilpatrick et al. |

FOREIGN PATENT DOCUMENTS

| | | | |
|---|---|---|---|
| EP | 1 072 541 Al | A1 | 1/2001 |
| EP | 2 650 084 | A1 | 10/2013 |
| WO | WO 97/01301 | A1 | 1/1997 |
| WO | WO 2010/095233 | A1 | 8/2010 |
| WO | WO 2013/120049 | A1 | 8/2013 |
| WO | WO 2013/173338 | A1 | 11/2013 |

OTHER PUBLICATIONS

International Search Report and Written Opinion dated Jun. 20, 2016 in PCT Application No. PCT/US2016/015111 filed Jan. 27, 2016.

International Preliminary Report on Patentability dated Aug. 10, 2017 in PCT Application No. PCT/US2016/015111 filed Jan. 27, 2016.

SNOW THROWER IMPELLER

CROSS REFERENCE TO RELATED APPLICATION

This application is a continuation application from U.S. patent application Ser. No. 15/544,577, which is incorporated by reference herein, and this application is a National Phase application of PCT/US2016/015111 filed Jan. 27, 2016, which also claims the priority benefit of U.S. Provisional Patent Application Ser. No. 62/108,116 filed Jan. 27, 2015.

BACKGROUND

1. Field of the Disclosure

This application relates generally to snow throwing power equipment, and more specifically to snow throwing power equipment including at least two stages, the final stage including an impeller with wipers.

2. Description of Related Art

Currently available powered snow throwers are generally provided with mechanisms configured to throw quantities of snow, ice, water, etc. after the quantities enter a housing at the front of the snow thrower. The mechanisms often include impellers located within an impeller housing. The impellers and the impeller housings are typically constructed of metal, and a gap is designed to exist between the impeller and the impeller housing to prevent contact between the two structures such as U.S. Pat. No. 7,121,021. This gap allows snow, ice, and water to accumulate in the gap, decreasing the efficiency of the impeller.

Other snow throwers or material movers can include linear impeller blades having wipers attached to the impeller blades to lessen the accumulating material between the impeller and the impeller housing such as U.S. Pat. No. 7,597,219. However, the wipers are fixed relative to the impeller blades and cannot account for imperfections in the impeller housing, wear on the wipers, etc. Accordingly, improvements to snow thrower impellers are desired.

SUMMARY

The following presents a simplified summary in order to provide a basic understanding of some example aspects of the disclosure. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

According to one aspect, the subject application involves an impeller assembly. The impeller assembly includes an impeller located within an associated impeller housing. The associated impeller housing defines an interior wall. The impeller includes a central axis of rotation and an outer circumference. The impeller defines a mounting slot. The impeller includes a hub located about the central axis of rotation and an impeller blade connected to the hub. The impeller blade extends from the hub toward the outer circumference. The impeller assembly also includes a wiper mounted adjacent the impeller blade. The wiper includes a wiper portion that slides into the mounting slot to mount the wiper to the impeller. The wiper contacts the interior wall of the associated impeller housing during rotational operation of the impeller in order to limit a gap between the impeller blade and the interior wall.

According to another aspect, the subject application involves an impeller assembly including an impeller located within an associated impeller housing. The associated impeller housing defines an interior wall. The impeller includes a central axis of rotation and an outer circumference. The impeller also includes a hub located about the central axis of rotation. The impeller further includes an impeller blade connected to the hub. The impeller blade includes a first blade portion and a second blade portion. The impeller blade extends from the hub toward the outer circumference. The second blade portion of the impeller blade extends at a non-zero angle from the first blade portion of the impeller blade.

According to another aspect, the subject application involves a method of improving an efficiency of a snow thrower impeller. The method includes the step of providing a multiple-stage snow thrower comprising an impeller assembly. The impeller assembly includes an impeller housing that defines an interior wall. The impeller assembly also includes an impeller located within the impeller housing. The impeller includes a central axis of rotation and an outer circumference, and the impeller defines a mounting slot. The impeller includes a hub located about the central axis of rotation and an impeller blade connected to the hub. The impeller blade extends from the hub toward the outer circumference. The impeller assembly also includes a wiper mounted adjacent the impeller blade. The wiper includes a wiper portion, and the wiper is mounted without the use of fasteners or tools. The wiper contacts the interior wall of the impeller assembly during rotational operation of the impeller in order to limit a gap between the impeller blade and the interior wall. The method also includes the step of inserting the wiper into the mounting slot by hand and without the use of tools. The method further includes the step of operating the impeller by providing a rotational force to the impeller, wherein the wiper maintains contact with the interior wall during impeller rotation.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

DETAILED DESCRIPTION

Figure 1:
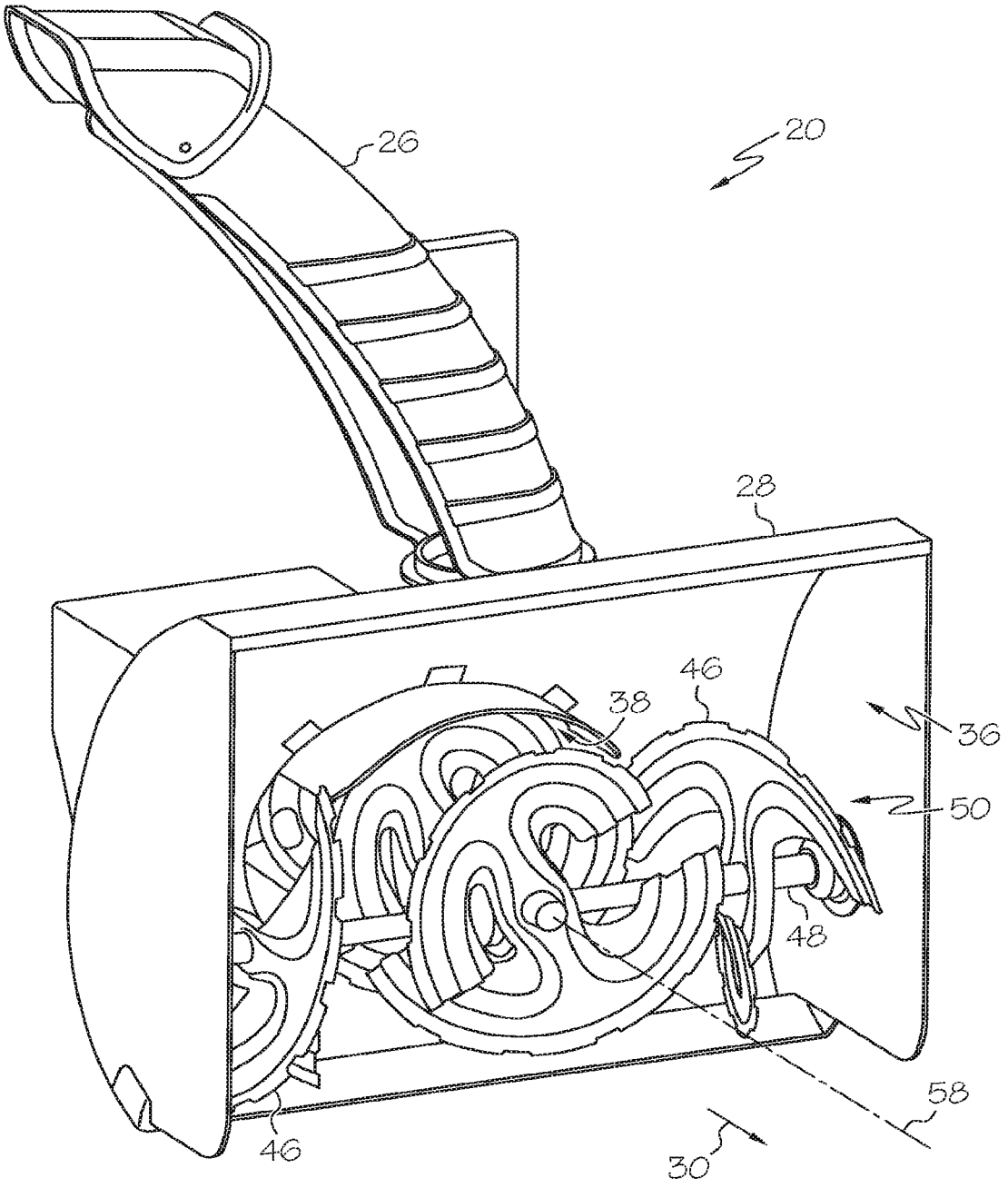
FIG. 1 is a perspective view of a portion of an example snow thrower according to an aspect of the present disclosure.
Figure 3:
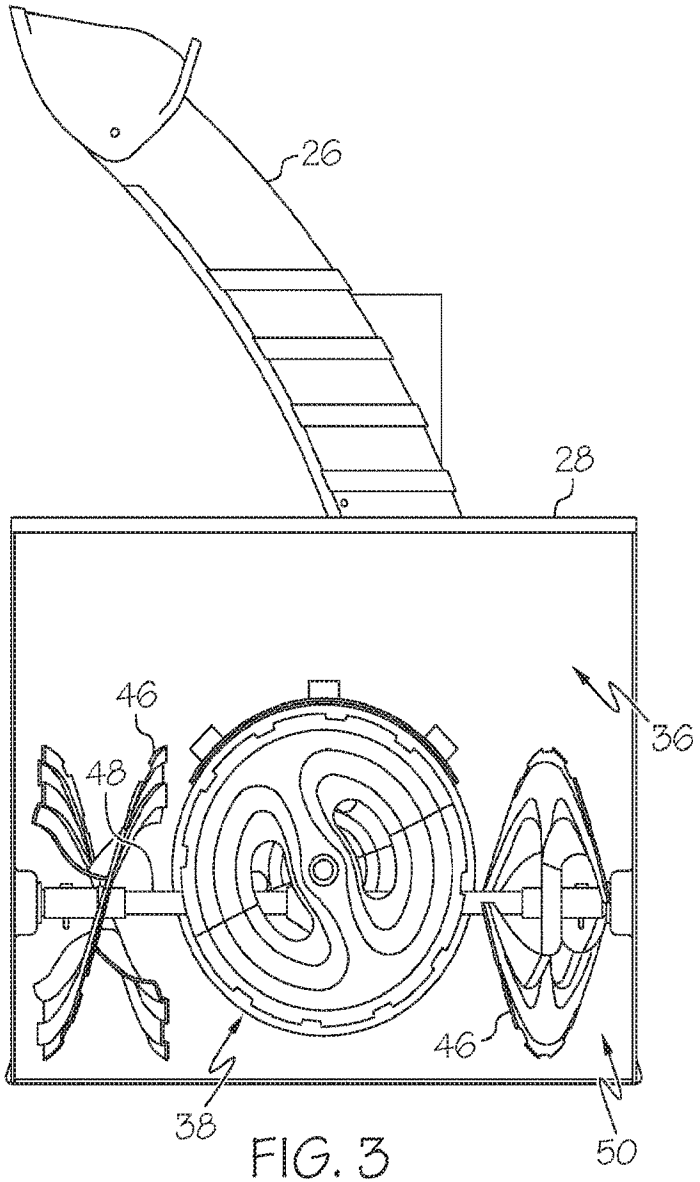
FIG. 3 is an elevation front view of the portion of the snow thrower of FIG. 1.

Example embodiments that incorporate one or more aspects of the present disclosure are described and illustrated in the drawings. These illustrated examples are not intended to be a limitation on the present disclosure. For example, one or more aspects of the present disclosure can be utilized in other embodiments and even other types of devices. Moreover, certain terminology is used herein for convenience only and is not to be taken as a limitation on the present disclosure. Still further, in the drawings, the same reference numerals are employed for designating the same elements.

FIG. 1 shows a perspective view of a front portion of a powered snow thrower 20 including an impeller assembly 24 (best seen in FIG. 2) according to at least one aspect of the present disclosure. It should be understood by one of ordinary skill in the art that the snow thrower 20 may alternatively include a power supply such as a cord to receive electrical power, an internal combustion engine, a rechargeable battery, or any other commonly known power supplies. The snow thrower 20 can also include a pair of graspable handles (not shown) attached to the power supply that can be used by an operator to control the direction and movement of the snow thrower 20. The snow thrower 20 also includes tracks or a pair of wheels (not shown) attached to the power supply for allowing the snow thrower to roll along the ground while removing accumulated snow.

The snow thrower 20 is configured to remove piled-up snow and propels, or throws the snow from a chute 26 to a different location. The chute 26 is operatively connected to a housing 28 into which snow, ice, etc. enters the snow thrower 20 as the snow thrower 20 moves in a forward direction (represented by arrow 30). For the remainder of the disclosure, the snow thrower 20 will be shown and discussed in the form of a multi-stage snow thrower having a first stage auger device driven on a shaft substantially perpendicular to the direction of travel of the snow thrower 20, a second stage auger device driven on a shaft substantially parallel with the forward direction 30 of the snow thrower 20, and a third stage impeller device. It is to be understood that the described impeller assembly 24 can also be used on snow throwers 20 having two stages, four stages, etc., with the final stage being the impeller assembly 24. Other examples of the snow thrower 20 can include an accelerator (not shown) that moves snow into the impeller housing 34.

Figure 2:
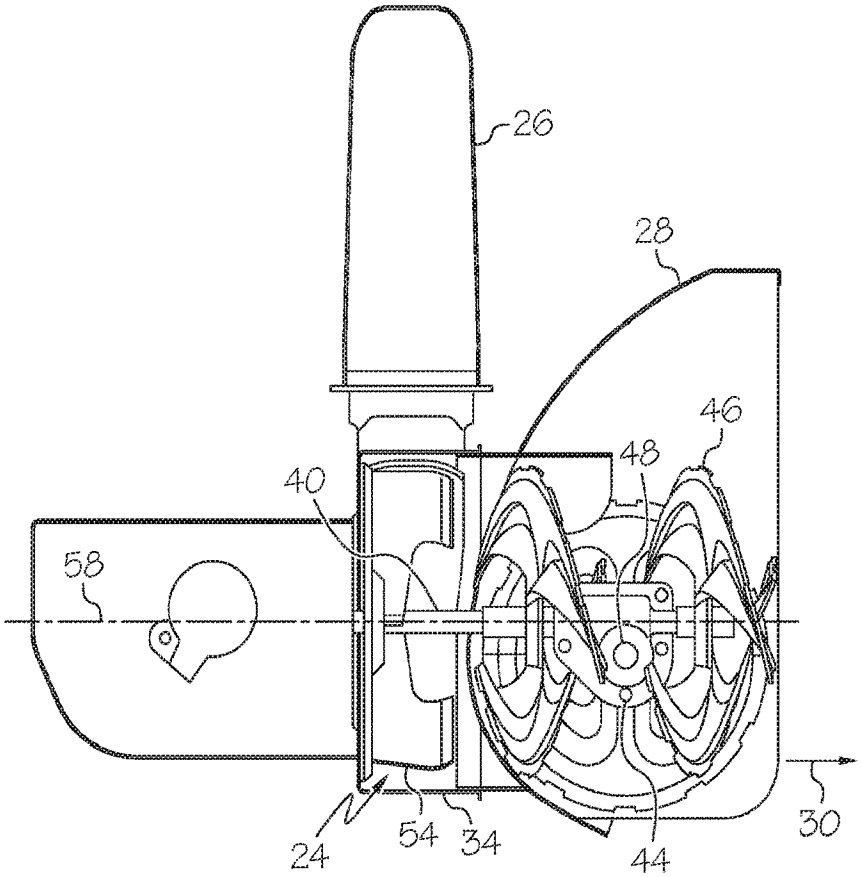
FIG. 2 is an elevation side view of the portion of the snow thrower of FIG. 1 including an impeller assembly.

As shown in FIGS. 1 and 2, the housing 28 is a generally semi-cylindrical, or C-shaped casing including an impeller housing 34 extending rearwardly from the central C-shaped portion, wherein the housing 28 is longitudinally oriented in a transverse direction relative to the forward direction 30 of movement of the snow thrower 20. The housing 28 includes an opening 36 into which snow enters the housing 28 and an outlet aperture 38 through which the snow is forced to exit the housing 28 into the impeller housing 34.

Turning to FIG. 2, in one example, a distal end of a longitudinal drive shaft 40 is connected to the power supply (not shown) and the opposing end of the longitudinal drive shaft 40 is operatively connected to a gear assembly 44 that is positioned within the housing 28.

The snow thrower 20 includes at least two augers 46, wherein at least one auger 46 is attached to each portion of a lateral drive shaft 48 extending from the gear assembly 44, as shown in FIGS. 1-4. In the illustrated exemplary embodiment, one (1) auger 46 is positioned on each of two portions of the lateral drive shaft 48 extending from the gear assembly 44. It should be understood by one of ordinary skill in the art that although the illustrated embodiment of a first stage assembly 50 includes only two augers 46, the first stage assembly 50 can include any number of augers 46 positioned adjacent to each side of the gear assembly 44 on the lateral drive shaft 48. The augers 46 can be removably connected to the longitudinal and lateral drive shafts 40, 48 by way of a connecting mechanism such as a nut-and-bolt, cotter pin, or the like. The augers 46 are configured to move snow axially along the lateral drive shaft 48, wherein the augers 46 located on opposing portions of the lateral drive shaft 48 relative to the gear assembly 44 are configured to move snow in an opposing manner relative to the augers 46 on the opposing portion of the lateral drive shaft 48. As such, the augers 46 are configured to move snow, ice and other material toward the center of the housing 28, or toward the gear assembly 44 that is positioned at or near the center of the housing 28.

It should be understood by one of ordinary skill in the art that the augers 46 can be configured in a corkscrew or spiral shape or orientation relative to the drive shaft 40, 48 to which they are attached such that rotation of the augers 46 push snow along the axis of rotation of the respective drive shaft. For example, the augers 46 are configured to rotate and push or transport the snow in the direction from the side walls of the housing 28 toward the centrally-located gear assembly 44 and toward the impeller housing 34.

Figure 4:
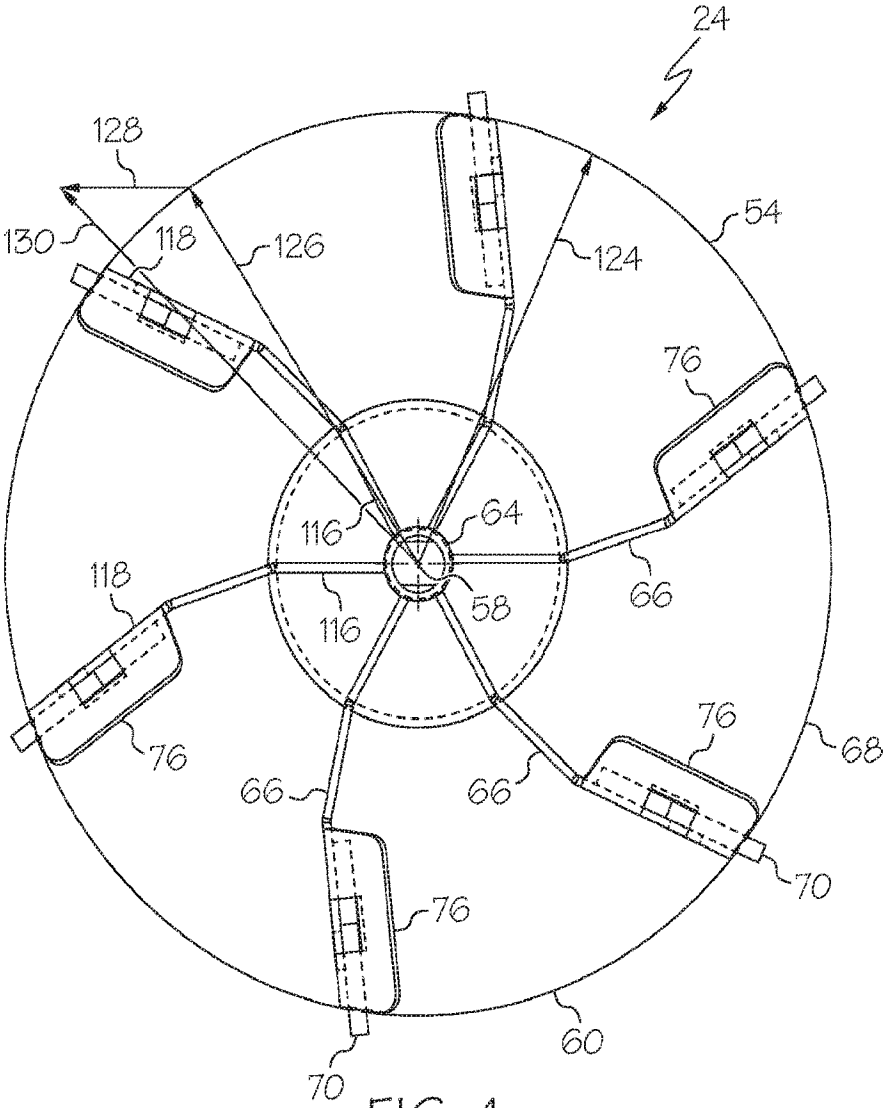
FIG. 4 is a top view of the impeller assembly of FIG. 2.

The snow thrower 20 includes the rotatable impeller assembly 24 operatively connected to the longitudinal drive shaft 40. The impeller assembly 24 includes an impeller 54 located within an impeller housing 34 which defines an interior wall 56, as shown in FIGS. 1-2 and 4. The impeller 54 is located on the longitudinal drive shaft 40 between the auger 46 and the power supply (not shown). The impeller 54 is configured to receive the snow from the auger 46, and through rotation of the impeller 54 about the longitudinal drive shaft 40 at a sufficient speed, the snow is expelled or centrifugally thrown through the chute 26 and away from the snow thrower 20. In one example, the impeller assembly 24 is removably attached to the longitudinal drive shaft 40 such that the impeller assembly 24 can be removed and replaced. The impeller assembly 24 can be attached to the longitudinal drive shaft 40 with any attachment mechanism such as nut-and-bolt, cotter pin, or the like.

In one example, the longitudinal drive shaft 40 is powered by the power supply such that the longitudinal drive shaft rotates between about 50 to about 1500 RPM. In one example, the impeller assembly 24 and the augers 46 are operatively connected to the longitudinal drive shaft 40 such that the impeller assembly 24 and the augers 46 rotate at substantially the same rotational velocity as the longitudinal drive shaft 40.

As shown in FIGS. 2 and 4, the impeller 54 includes a central axis of rotation (represented by point and/or line 58) and an outer circumference 60. The impeller 54 also includes a hub 64 located about the central axis of rotation 58. The hub 64 can provide a mounting point for the impeller 54 to be mounted to the longitudinal drive shaft 40. In one example, the impeller 54 is attached to the longitudinal drive shaft 40 by sliding the hub 64 over the outer surface of the longitudinal drive shaft 40 and securing the impeller 54 to the drive shaft 40 by way of an attachment mechanism such as a nut-and-bolt, a cotter pin, or the like.

Turning to FIG. 4, the impeller 54 also includes an impeller blade 66 connected to the hub 64, and the impeller blade 66 extends from the hub 64 toward the outer circumference 60. In many cases, the impeller 54 includes a plurality of impeller blades 66 that extend radially outwardly from the hub 64. Each of the figures shows an impeller 54 including six (6) impeller blades, however, any number of impeller blades 66 can be included, including, but not limited to three, four, or five. In some cases, a greater number of impeller blades 66 (e.g., six), can lead to greater efficiencies, as snow and ice will spend less average time in the impeller housing 34.

While not required, the impeller 54 can also include a back plate 68. The hub 64 can be attached to the back plate 68 and located about the central axis of rotation 58. In the examples of the impeller 54 including the back plate 68, the impeller blade 66 can be connected to the hub 64 indirectly through the back plate 68 while not contacting the hub 64 directly. However, certain designs may include the impeller blades 66 directly connected to the hub 64 even when there is a back plate 68. In the examples with the back plate 68, the impeller blades 66 can extend from an interior location of the back plate 68 toward the outer circumference of the impeller 54 without contacting the hub 64.

The impeller assembly 24 also includes a wiper 70 mounted adjacent the impeller blade 66. In one example, the wiper 70 is composed of a flexible, resilient material, such as a rubber compound. For example, the wiper 70 can be composed of a rubber material including a fabric layer sandwiched within the rubber compound. The fabric layer can serve as reinforcement for the wiper structure. Any number of other flexible, resilient materials can be used to form the wiper 70.

Figure 10:
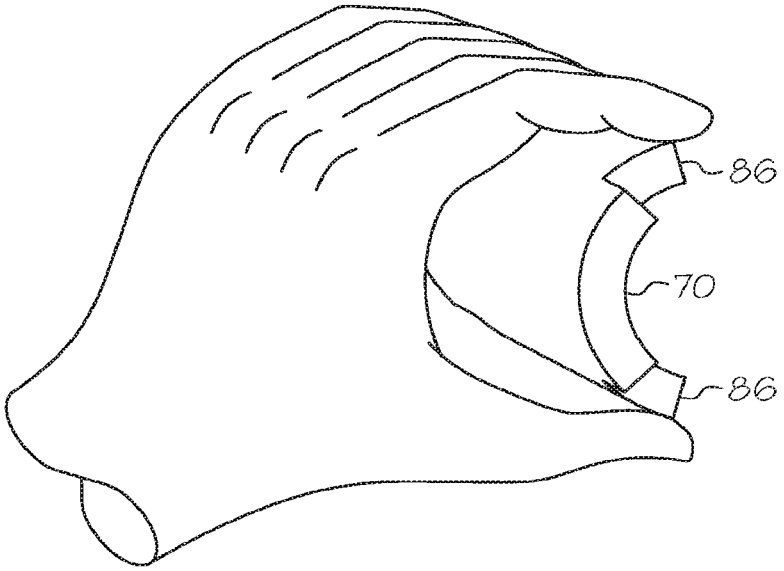
FIG. 10 shows deformation of a wiper by hand in order to mount the wiper to an impeller blade.

Turning to FIG. 10, regardless of the material used to form the wiper 70, one example of the wiper includes a wiper that can be deformed from an original shape upon application of pressure from an operator's hand and return to the original shape upon removal of the application of pressure from the operator's hand. This enables the wiper 70 to slide into a mounting slot which will be described below to mount the wiper 70 to the impeller blade 66. As such, the wiper 70 can be configured to be mounted to the impeller blade 66 without the use of fasteners or tools; an operator can simply squeeze the wiper 70 to deform it, and then release the squeeze force to enable the wiper 70 to return to its original shape and slide into the mounting slot.

The wiper 70 contacts the interior wall 56 of the impeller housing 34 during rotational operation of the impeller assembly 24 in order to limit and/or eliminate a gap 74 between the impeller blade 66 and the interior wall 56. Reduction and/or elimination of the gap 74 can lead to several benefits. For example, minimization of the gap 74 can lessen and/or eliminate quantities of snow, ice, etc. from accumulating in the annular space created by the gap 74, thereby reducing and/or eliminating recirculation of the material to be thrown by the snow thrower 20. This leads to greater efficiency of the snow thrower 20. Additionally, reduction and/or elimination of the gap 74 can lead to increased material throw distances for the snow thrower 20.

The impeller 54 can further include upper blade extensions 76 attached to the impeller blades 66. The upper blade extensions 76 can extend away from a top edge 78 of the impeller blade 66. The upper blade extensions 76 can generally extend axially away from the impeller blades 66, toward a direction of rotation 80, or a combination of these two directions. Inclusion of the upper blade extensions 76 can prevent snow, ice, water, etc. from leaving the impeller housing 34 through the outlet aperture 38 and returning to the housing 28 by acting as a rotating barrier to help keep the snow, ice, water, etc. within the impeller housing 34 prior to being thrown into the chute 26. In other words, the upper blade extensions 76 can act as "scoops" or "spoons" that help maintain the snow, ice, etc. in a path moving from the housing 28 to the chute 26. Additionally, the upper blade extensions 76 can also act as force concentration points which break-up larger chunks of snow and/or ice accumulations as the impeller rotates.

Figure 5:
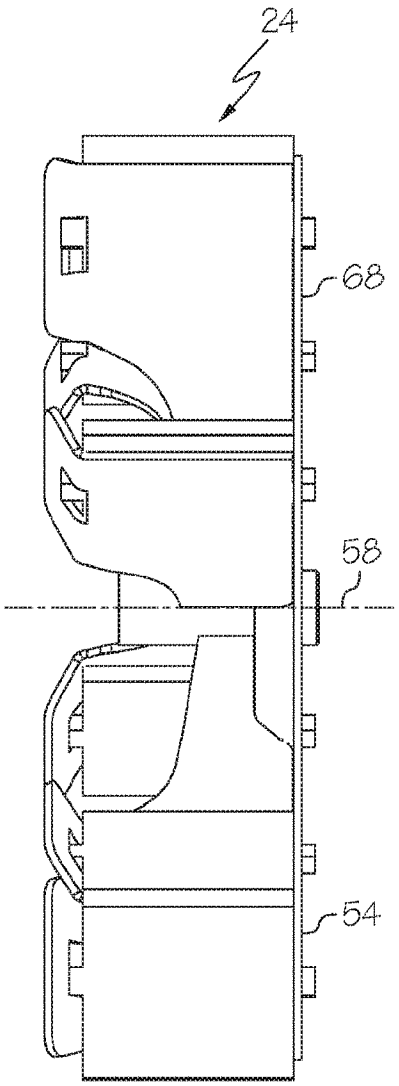
FIG. 5 is a side view of the impeller assembly of FIG. 2.
Figure 6:
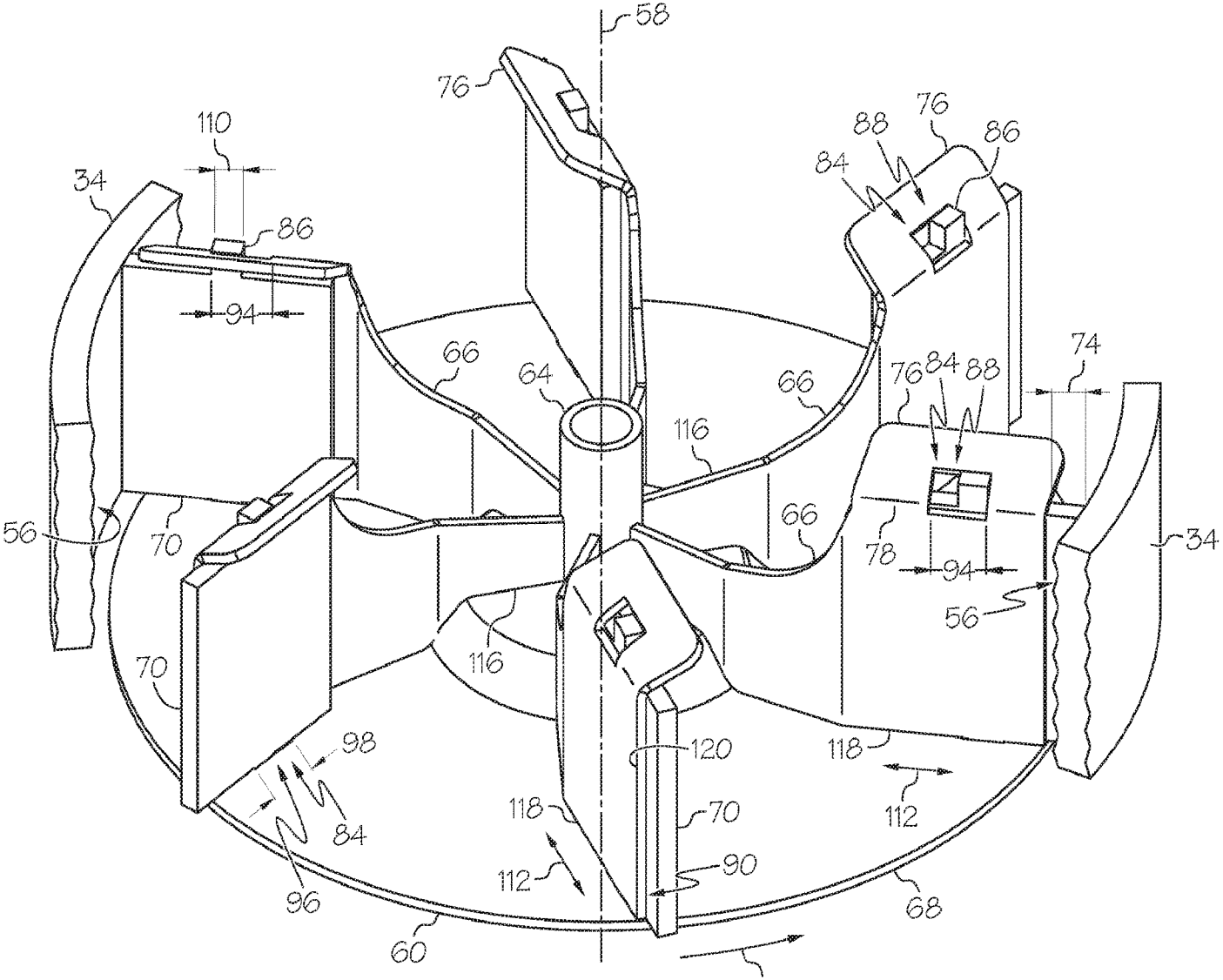
FIG. 6 is a perspective view of the impeller assembly of FIG. 2 showing a number of wipers in an outward-most position.

The impeller 54 defines a mounting slot 84, and the wiper 70 includes a wiper portion 86 that slides into the mounting slot 84 to mount the wiper 70 adjacent to the impeller blade 66. In one embodiment as shown in FIGS. 4-6, the upper blade extension 76 defines an upper mounting slot 88 (which is one example of the mounting slot 84) on a leading face side 90 of the impeller blade 66. The upper mounting slot 88 is oriented radially, or in a substantially radial orientation. The upper mounting slot 88 includes an upper mounting slot length 94. In some examples, the back plate 68 defines a lower mounting slot 96 generally opposing the upper mounting slot 88 defined by the upper blade extension 76. The lower mounting slot 96 includes a lower mounting slot length 98, which can be substantially equal to the upper mounting slot length 94. In this embodiment, the wiper portion 86 includes a radial section that is oriented radially, and the wiper portion 86 slides into the radial mounting slot 84 to mount the wiper 70 adjacent to the impeller blade 66. In this embodiment, the wiper 70 is located on the leading face side 90 of the impeller blade 66, and can be supported by the impeller blade 66 as it rotates and remains in contact with (or "wipes") the interior wall 56 of the impeller housing 34. In this embodiment, the wiper 70 can be the same width or substantially the same width as the impeller blade 66 as measured in the axial direction.

Figure 7:
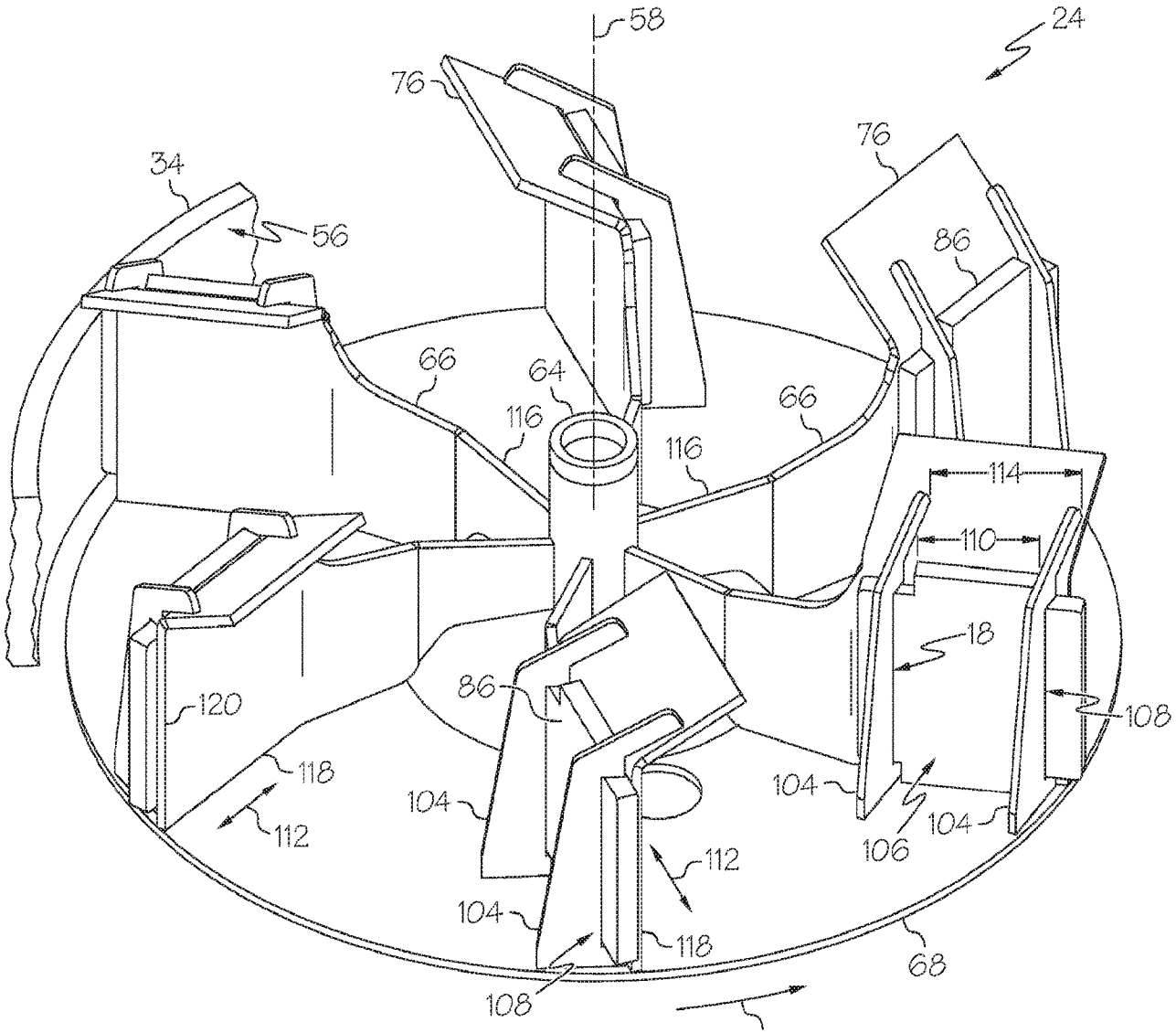
FIG. 7 is a perspective view of a second embodiment of an impeller assembly showing a second blade portion swept toward a direction of rotation of the impeller assembly.
Figure 8:
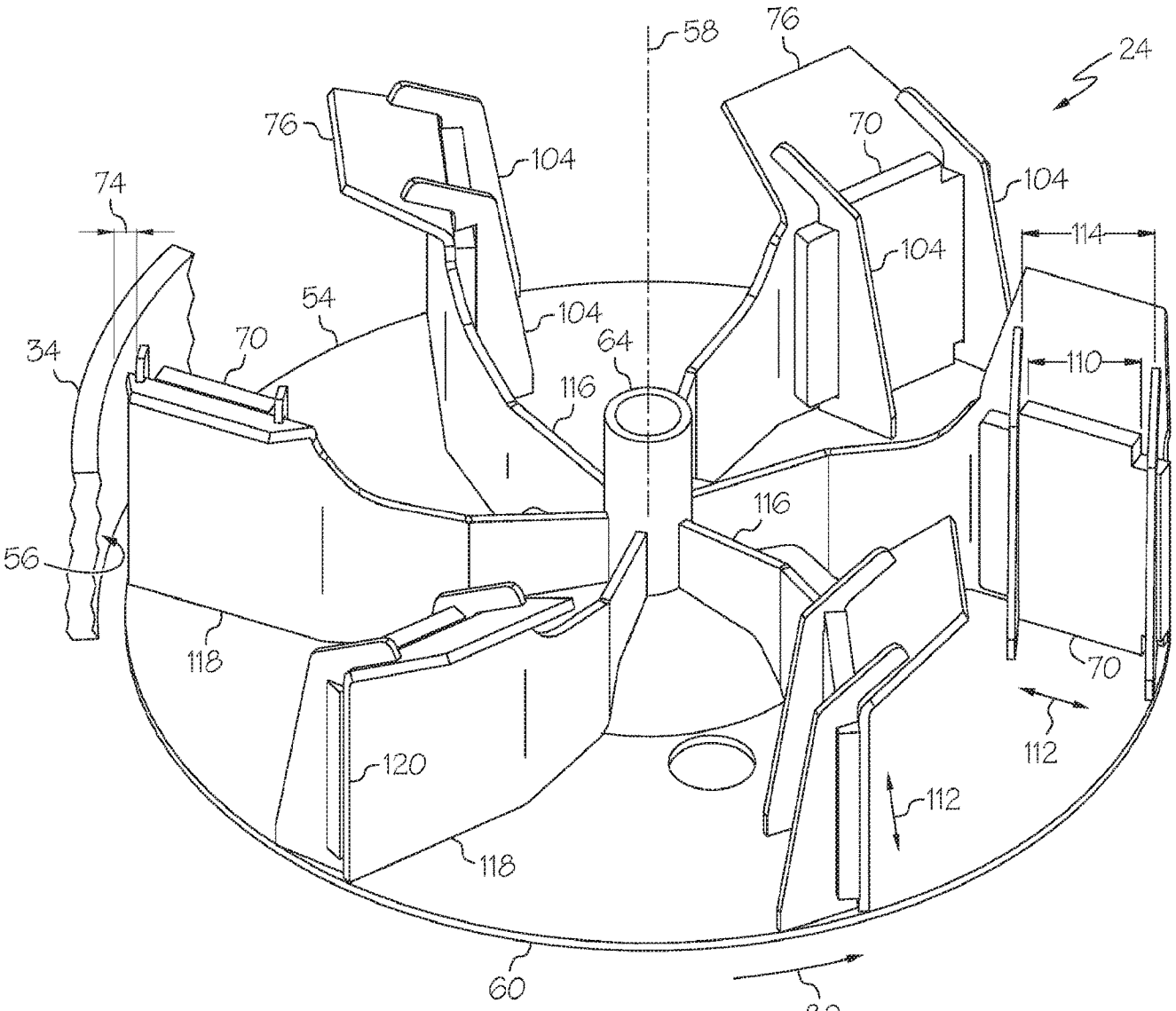
FIG. 8 is similar to FIG. 7 showing the second blade portion swept away from a direction of rotation of the impeller assembly.
Figure 9:
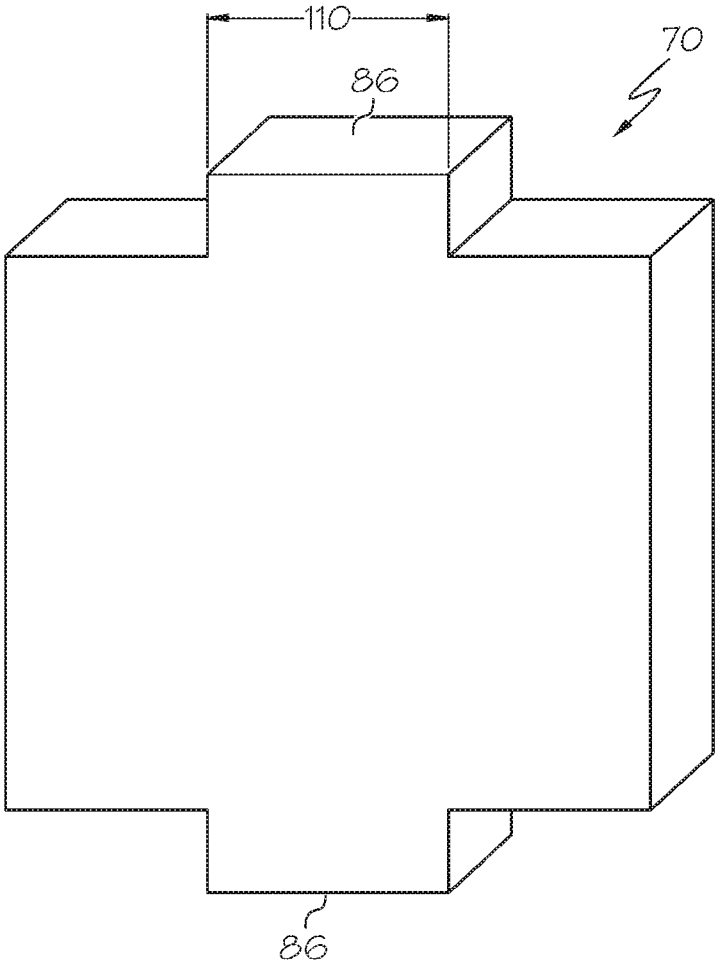
FIG. 9 is a perspective view of a wiper used on an impeller assembly of FIG. 1.

In another embodiment as shown in FIGS. 7 and 8, the impeller 54 can also include a plurality of retainer plates 104 located on a trailing side 106 of the impeller blade 66. The retainer plates 104 can extend from the trailing side 106 of the impeller blade 66 to the back plate 68. The retainer plates 104 define a rear mounting slot 108 (which is one example of the mounting slot 84). The rear mounting slot 108 is oriented axially, or in a substantially axial orientation. In this embodiment, the wiper portion 86 is oriented axially, and the wiper portion 86 slides into the axially oriented rear mounting slot 108 to mount the wiper 70 adjacent to the impeller blade 66.

Returning to FIG. 10, the figure represents an operator's hand applying a squeeze force to the wiper 70 to reduce the axial dimension in order to insert the wiper 70 into mounting slots 84 which will be oriented radially for the first embodiment. It is to be understood that the squeeze force will be applied in the transverse direction to mount the wiper 70 in the second embodiment that includes mounting slots 84 that are oriented axially.

In each of the above described embodiments, the construction of the impeller 54 and the wiper 70 enable the wiper 70 to move in a generally radial direction away from the hub 64 in order to maintain contact with the interior wall 56 of the impeller housing 34.

For example, in the first embodiment as shown in FIGS. 4-6, the upper mounting slot 88 includes an upper mounting slot length 94, and the wiper portion 86 includes a first wiper length 110. The upper mounting slot length 94 is greater than the first wiper length 110. Similarly, the lower mounting slot 96 includes a lower mounting slot length 98 that is greater than the first wiper length 110. The greater lengths of the mounting slots 94, 98 enable the wiper 70 to move in a generally radial direction (represented by arrow 112) away from the hub 64 in order to maintain contact with the interior wall 56 of the impeller housing 34 while remaining mounted to the impeller blade 66. With the ability of the wiper 70 to move in the radial direction 112, centrifugal force created during rotation of the impeller 54 during normal operation of the snow thrower 20 will urge the wiper 70 radially outward until the wiper 70 contacts the interior wall 56 of the impeller housing 34.

In the second embodiment as shown in FIGS. 7-8, one of the retainer plates 104 is mounted a distance of a mounting length 114 from the other retainer plate 104, and the mounting length 114 is greater than the first wiper length 110. This difference in lengths 114, 110 enables the wiper 70 to move in a generally radial direction 112 away from the hub 64 in order to maintain contact with the interior wall 56.

Figure 11:
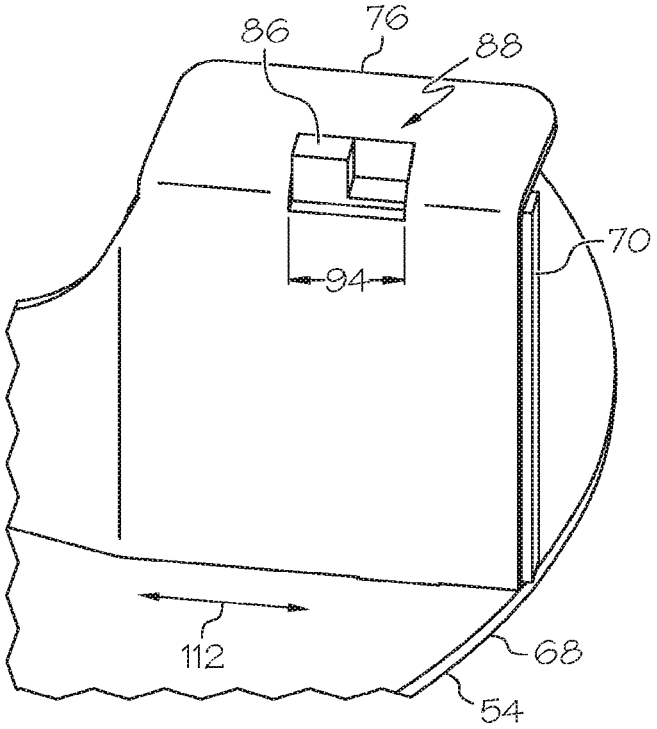
FIG. 11 is a detail view of the impeller assembly of FIG. 7 showing the wiper in a radially outward-most position.

FIGS. 4-6 show the first embodiment with the wiper 70 in the radially inward-most position. FIG. 11 shows the first embodiment with the wiper 70 in the radially outward-most position. FIG. 7 shows the second embodiment with the wiper 70 in the radially outward-most position while FIG. 8 shows the second embodiment in the radially inward-most position. Of course, the wiper 70 and impeller 54 can operate properly at any of the infinite wiper positions along the continuum between the inward-most and outward-most radial positions.

Enabling the wiper 70 to move radially can benefit the impeller 54 and the snow thrower 20 in multiple ways. In one example, rotation of the impeller 54 during normal operation may wear away an amount of the wiper 70 at the point of contact with the interior wall 56 of the impeller housing 34. As the wiper 70 wears, contact with the interior wall 56 can be maintained as the wiper 70 simply moves radially outward to compensate for the worn away wiper material.

In another example, the wiper 70 is not statically fixed to the impeller blade 66, and can thus move radially to contact the interior wall 56, regardless of the distance between the hub 64 and the interior wall 56. This enables the wiper 70 to automatically move without requiring an operator to manually move the wiper 70.

In yet another example, the interior wall 56 of the impeller housing 34 may include manufacturing imperfections such that the cross-section of the interior wall 56 is not perfectly circular. Even with potential inconsistencies in the radius of the interior wall 56, the wiper 70 will move radially out and radially in to maintain contact with the interior wall 56 as the impeller 54 rotates. This constant contact helps ensure that the previously described benefits of the wipers 70 are maintained throughout the entire arc of rotation of the impeller 54.

In still yet another example, one step during assembly of the snow thrower 20, can include passing the impeller assembly 24 through the opening 36 from the housing 28 into the impeller housing 34 where the impeller assembly 24 can then be secured to the drive shaft 40. In some of those instances, the opening 36 can be of a smaller diameter than the diameter of the interior wall 56 of the impeller housing 34. However, the intent of the wipers 70 is to be in a position of the wider interior wall diameter to contact the interior wall 56. This would normally create a physical interference, preventing the step of passing the impeller assembly 24 through the opening 36. However, as the wipers 70 can be moved radially, the assembly step can include an operator moving the wipers 70 radially inward such that the diameter of the impeller 54 with the wipers 70 is less than the diameter of the opening 36. This eases the assembly process of the snow thrower 20. Then, during normal operation, centrifugal force will move the wipers to increase the effective diameter of the impeller 54 such that the wipers 70 contact the interior wall 56 of the impeller housing 34 during normal operation.

It is to be understood that additional mass within the wipers 70 can accentuate the effect of the centrifugal force pushing the wipers 70 into contact with the interior wall 56. As such, the wiper 70 can have various appendages or add-ons that increase the weight to improve the effectiveness of the wiper 70 contact with the interior wall 56. In one example, the wiper 70 can include a metal layer surrounded by rubber. However, appropriate care must be taken during design of this particular wiper such that the metal content of the wiper will never contact the interior wall 56, even after anticipated wear of the relatively soft wiper material. Metal-on-metal contact within the impeller housing can be detrimental to performance of the snow thrower 20.

In one example, the lengths of the mounting slots 94, 98 and the mounting length 114 and the lengths of the wiper portion 86 can be designed, calculated, and manufactured such that the wiper 70 does not reach the limit of its radially outward potential movement prior to the anticipated life cycle of the snow thrower 20, even when considering normal wear effects on the wiper 70. In another example, the wipers 70 can be replaced by new wipers 70 in the event that so much material has worn away from the wiper 70 that contact is no longer maintained with the interior wall 56. In yet another example, the relatively soft material used for the wiper 70 may enable an operator to cut away a part of the wiper portion 86, enabling the wiper 70 to move farther outward radially to maintain contact with the interior wall 56. Other examples of wipers may include removable sections of the wiper portion 86, enabling the same effect of cutting away a portion of the wiper 70.

In one example, the impeller blade 66 can be substantially flat and straight, extending from the hub 64 along a radius of the impeller 54. In another example, as shown in FIGS. 4-8, the impeller blade 66 includes a first blade portion 116 and a second blade portion 118. The first blade portion 116 and the second blade portion 118 can be positioned such that the second blade portion 118 of the impeller blade 66 extends at a non-zero angle from the first blade portion 116 of the impeller blade 66. In other words, the first blade portion 116 and the second blade portion 118 form an angle that is not 0° or 180°. In yet another example, the impeller blade 66 can be formed in a curvilinear fashion rather than the segmented linear portions previously described. The curvilinear construction can be constructed such that the second blade portion 118 is simply a curved part of the impeller blade 66 that is closer to the outer circumference 60.

In some examples, as shown in FIGS. 4-7, the second blade portion 118 of the impeller blade 66 is positioned at an angle from the first blade portion 116 such that the second blade portion 118 extends toward a direction of rotation (as represented by arrow 80) of the impeller 54. This position may also be described as positioning the second blade portion 118 to be "swept toward" the direction of rotation 80 of the impeller 54. In this position, an edge 120 of the second blade portion 118 passes by a stationary point on the interior wall 56 prior to any other segment of the second blade portion 118 during rotation of the impeller 54. At times, it can be advantageous to orient the second blade portion 118 toward the direction of rotation 80, as the velocity of the collected snow, ice, water, etc. thrown by the impeller 54 can exceed the tip speed velocity of the impeller 54. This can lead to greater throw distances of snow, ice, water, etc. when compared to the throw distances developed by impellers having impeller blades that are not swept toward the direction of rotation of the impeller 54.

This increase in velocity is depicted in FIG. 4. A radius 124 of the impeller 54 is shown, and the magnitude of the angular velocity of a snow or ice particle leaving the impeller blade 66 is represented by the length of the vector 126 which is equal to the tip velocity of the impeller blade 66. However, the swept forward orientation of the second blade portion 118 imparts another vector component to the particle velocity as represented by the length of the vector 128. The sum of the velocity vectors 126, 128 is represented by the vector 130 having a magnitude larger than the tip velocity of the impeller blade 66.

In other examples, as the one shown in FIG. 8, the second blade portion 118 of the impeller blade 66 is positioned at an angle from the first blade portion 116 such that the second blade portion 118 extends away from the direction of rotation 80 of the impeller 54. This position may also be described as orienting the second blade portion 118 to be "swept away" from the direction of rotation 80 of the impeller 54. At times, it can be advantageous to position the second blade portion 118 away from the direction of rotation 80, as this can increase the efficiency of the impeller.

In another example, each blade 46 includes a tip 50 that extends from the end of the blade 46 in a curved manner. The tips 50 are curved in the direction of rotation of the impeller 54. The curved tips 50 assist in maintaining contact between the snow and the blades 46 as the impeller 54 rotates, thereby preventing the snow from sliding past the ends of the blades 46 to the gap between the blades 46 and the impeller housing 34 before the snow is thrown into and from the chute 26. Preventing the snow from sliding past the end of the blades 46 results in less re-circulation of the snow within the impeller housing 34, thereby making the snow thrower 20 more efficient in expelling the snow. Whereas the augers 46 are configured to push snow axially along the axis of rotation of the auger 46, the impeller 54 is configured to drive or throw snow in a radial direction away from the axis of rotation of the impeller 54. The impeller 54 and the auger 46 immediately adjacent thereto are oriented and timed such that they rotate at the same angular velocity, wherein as the snow slides from the end of the flight 36 of the auger 46 toward the impeller 54, the impeller 54 is positioned such that the snow enters the gap between adjacent blades 46 of the impeller 54 so that re-circulation of the snow is reduced.

Figure 12:
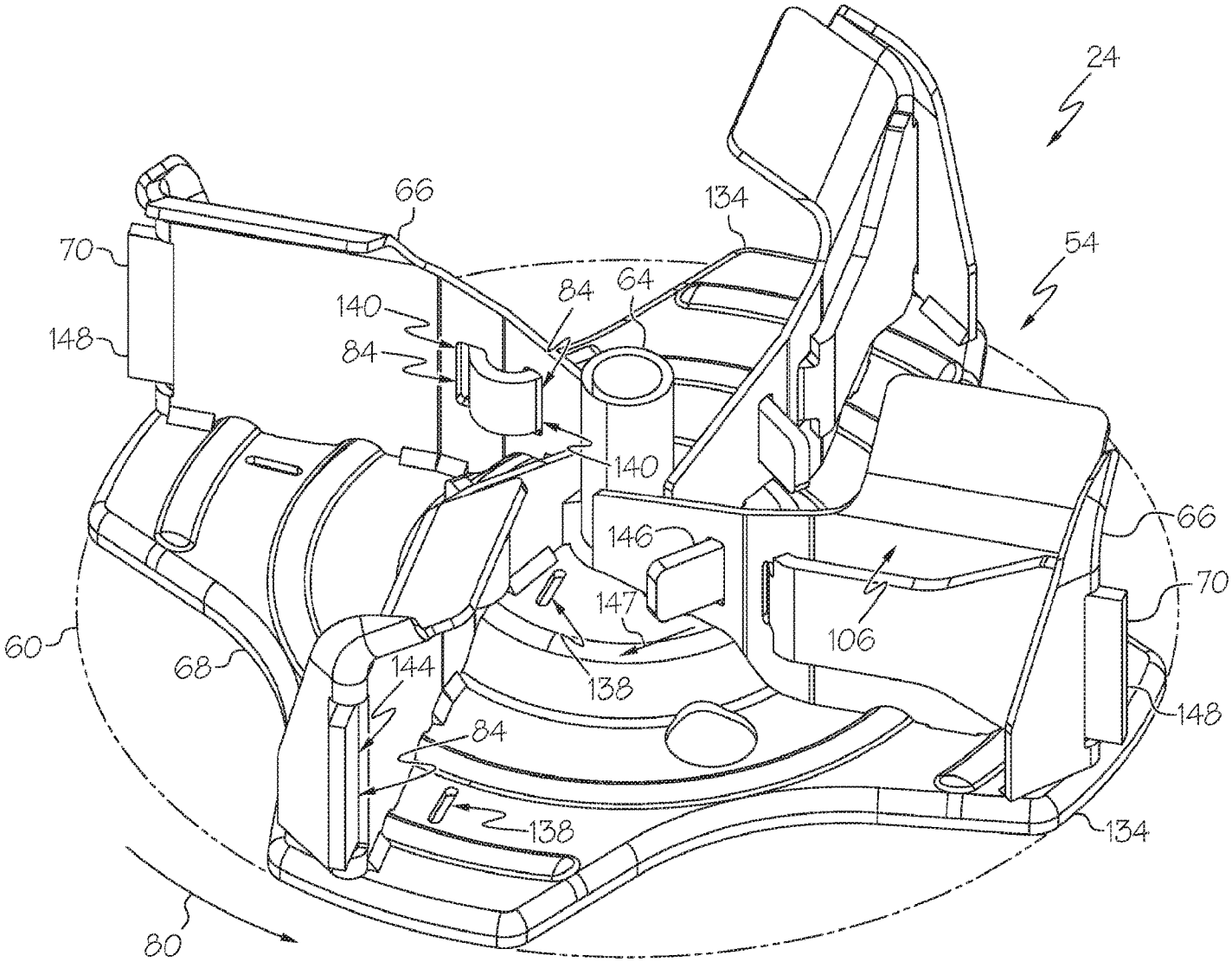
FIG. 12 is a perspective view of a third embodiment of an impeller assembly showing four impeller blades and a wiper woven into each blade.
Figure 13:
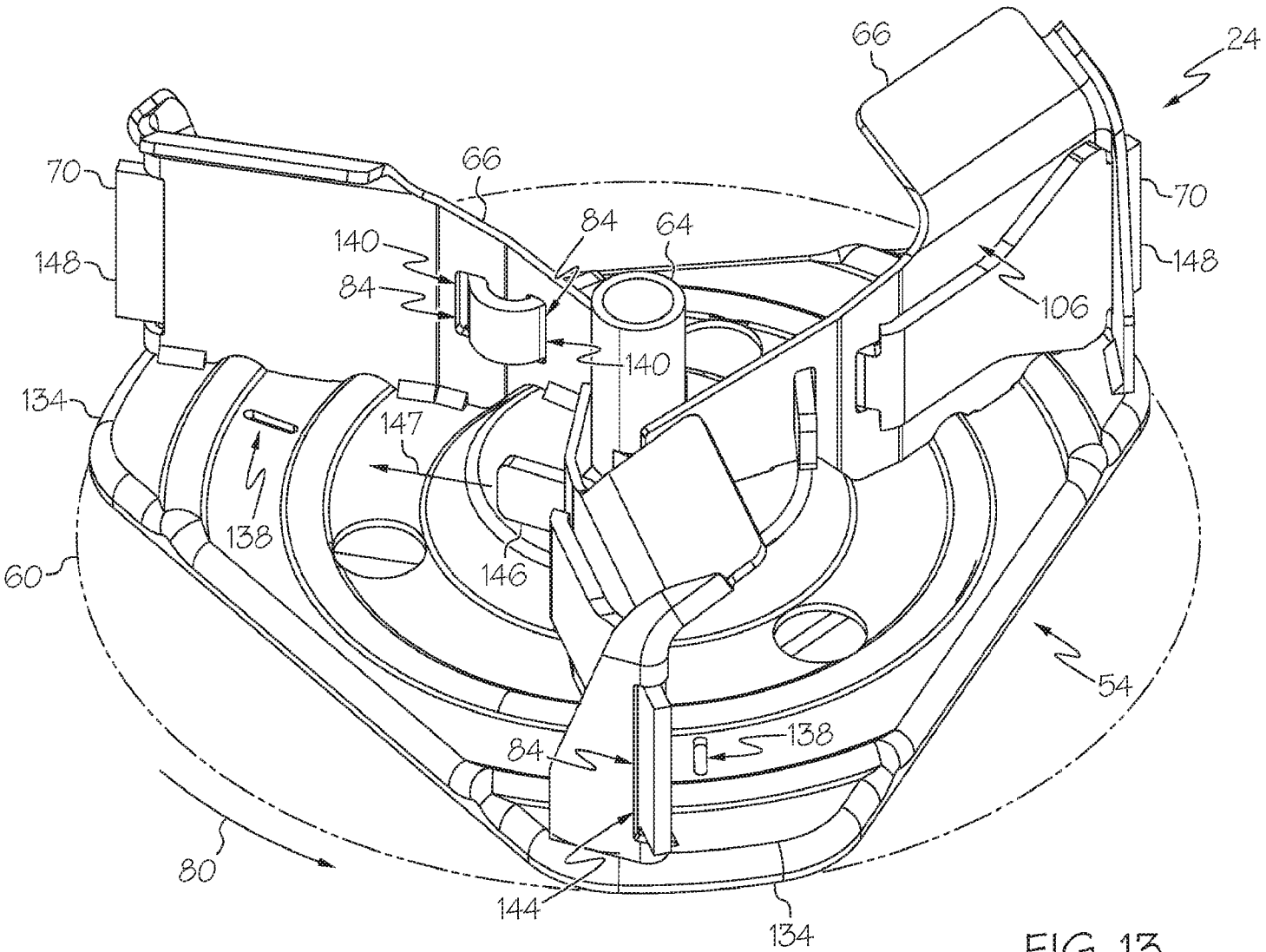
FIG. 13 is similar to FIG. 12 showing an impeller with three impeller blades.

Turning to FIGS. 12 and 13, another embodiment of the impeller assembly 24 is shown. As shown in FIG. 12, the impeller 54 can include four (4) impeller blades 66. In one example, the back plate 68 can include a number of lobes 134 commensurate with the number of impeller blades 66. In other examples, the back plate 68 can be circular as shown in several of the previous figures. Similarly, as shown in FIG. 13, the impeller 54 can include three (3) impeller blades 66 and lobes 134. In some example snow throwers 20, the choice of the number of impeller blades 66 used on the impeller 54 can be determined using an anticipated flow rate of snow entering the impeller housing 34 (best seen in FIG. 2). For example, a greater number of impeller blades 66 can be more efficient when the snow thrower 20 is used for greater flow rates of snow entering the impeller housing 34.

Figure 14:
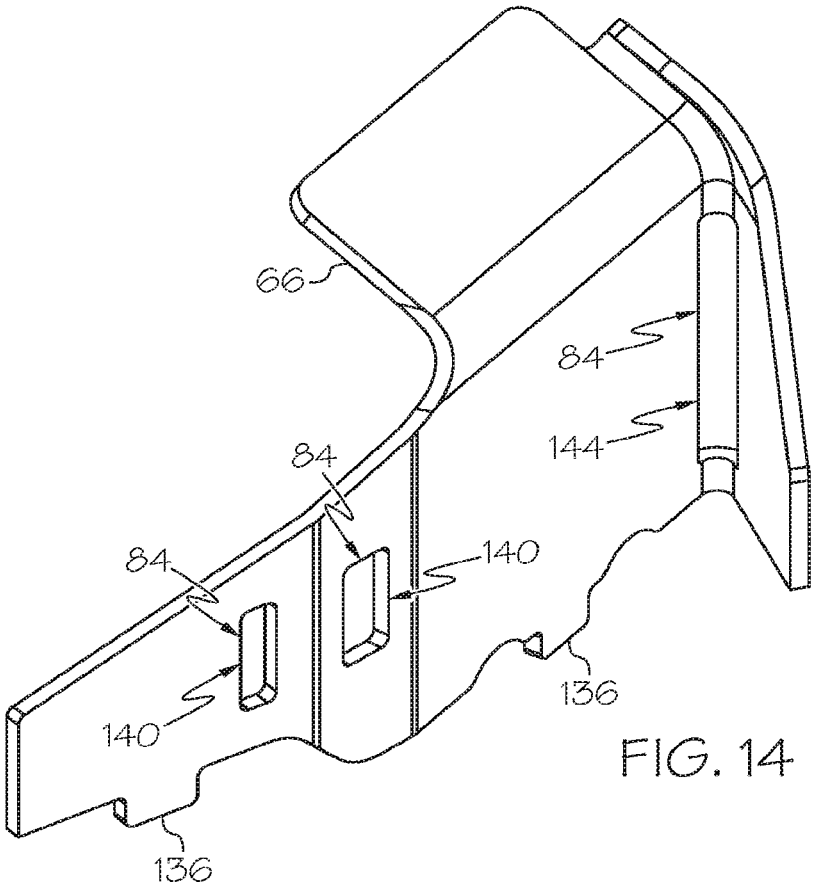
FIG. 14 is a perspective view an example impeller blade from the impeller assembly of FIG. 12 or FIG. 13.

Turning to FIG. 14, the impeller blade 66 can include at least one tab 136 that can be used to mount the impeller blade 66 to the back plate 68 through slots 138 (best seen in FIG. 12). In one example, the back plate 68 can include a number of slots and/or slot patterns that can accommodate various styles of impeller blades 66. Any suitable attachment method can be used to attach the impeller blades 66 to the back plate 68. Additionally, the impeller blade 66 can define a plurality of mounting slots 84. In one example, the mounting slots 84 are vertically oriented with two smaller mounting slots 140 located relatively close to the hub 64, and one larger mounting slot 144 located closer to the outer circumference of the impeller 54.

Figure 15:
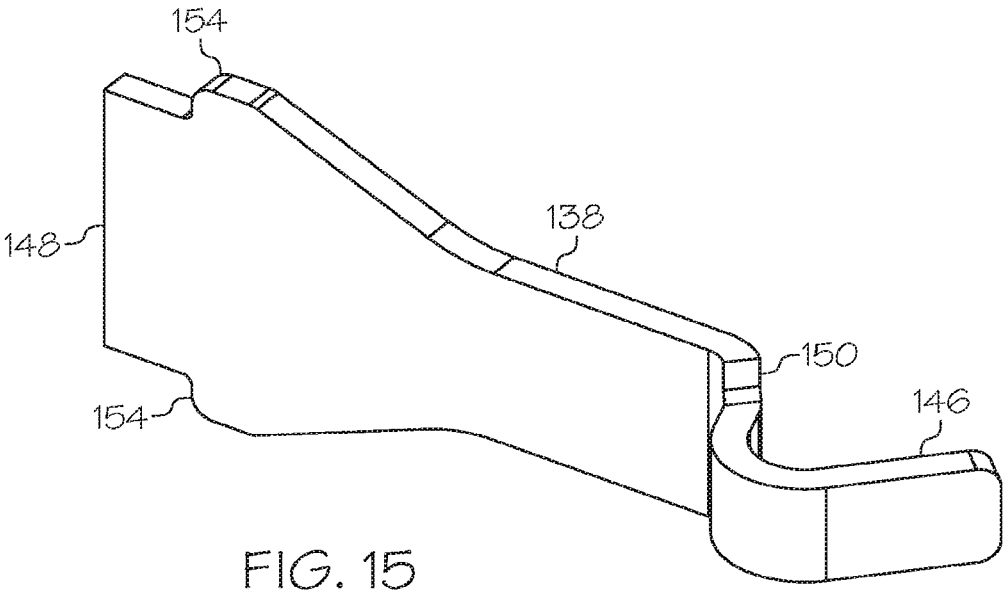
FIG. 15 is a perspective view of an example wiper from the impeller assembly of FIG. 12 or FIG. 13.

Turning to FIG. 15, a wiper 138 can be configured to interact with the impeller blade 66 of the embodiment shown in FIGS. 12 and 13. A first end portion 146 of the wiper 138 passes through one of the smaller mounting slots 140 and then through another smaller mounting slot 140 such that the wiper 138 is "woven" through the smaller mounting slots 140 and mounts the wiper 138 to the impeller 54. The first end portion 146 can include a shoulder 150 which can limit the length of the wiper 138 that can be woven into the impeller blade 66. The wiper 138 can be pulled tight by the operator pulling on the first end portion 146 in the direction of arrow 147 as shown in FIGS. 12 and 13. This woven feature can act as both a locking feature for the wiper 138 and a feature to prevent the first end portion 146 from slapping the impeller blade 66 during operation. Additionally, the wiper 138 is configured to be mounted to the impeller blade 66 without the need for tools, similar to the operation shown in FIG. 10.

Returning to FIG. 12, a second end portion 148 of the wiper 138 which is closer to the outer circumference 60 is configured to pass through the larger mounting slot 144. Similar to the first end portion 146, the second end portion 148 can include a shoulder 154 that contacts a portion of the impeller blade 66 at each end of the larger mounting slot 144. This interaction provides a physical interference that prevents the wiper 138 from moving through the larger mounting slot 144 toward the outer circumference 60 beyond a desired distance. In some examples, there can be a benefit to limiting the distance that the wiper 138 extends beyond the outer circumference 60 of the impeller 54. For example, the wiper 138 can be used to limit the distance between the impeller blade 66 and the interior wall 56, but not touch the interior wall 56. In this way, the wiper 138 will likely not contact the outlet aperture 38 (also known as a blower cup in some instances) which can create an undesirable loud noise caused by the slapping of the wiper 138 as it contacts the outlet aperture 38 on each rotation.

It is to be noted that the impeller assemblies shown in FIGS. 12 and 13 include the wiper 138 mounted on the trailing side 106 of the impeller blade 66. This mounting location can provide the benefit of a relatively smooth surface for snow, ice, water, etc. to flow along the surface of the impeller blade 66 as it undergoes centrifugal force, propelling it outward along the face of the impeller blade 66.

This is true for all of the embodiments in this disclosure that include the wiper mounted on the trailing side 106 of the impeller blade 66.

The description now turns to a method of improving an efficiency of a snow thrower impeller. The method includes the step of providing a multiple-stage snow thrower including the impeller assembly. The impeller assembly includes the impeller housing that defines the interior wall. The impeller assembly also includes the impeller located within the impeller housing. The impeller includes a central axis of rotation and an outer circumference while defining a mounting slot.

The impeller includes a hub located about the central axis of rotation and the impeller blade connected to the hub. The impeller blade extends from the hub toward the outer circumference. The impeller assembly also includes the wiper mounted adjacent the impeller blade. The wiper includes the wiper portion that enables insertion of the wiper portion into the mounting slot without the use of fasteners or tools. The wiper contacts the interior wall of the impeller assembly during rotational operation of the impeller in order to limit the gap between the impeller blade and the interior wall. The method also includes the step of inserting the wiper into the mounting slot by hand and without the use of tools. The method still further includes the step of operating the impeller by providing a rotational force to the impeller, and the wiper maintains contact with the interior wall during impeller rotation.

While this disclosure has been written in conjunction with the specific embodiments described above, it is evident that many alternatives, combinations, modifications and variations are apparent to those skilled in the art. Accordingly, the described embodiments of this disclosure, as set forth above are intended to be illustrative only, and not in a limiting sense. Various changes can be made without departing from the spirit and scope of this disclosure. Combinations of the above embodiments and other embodiments will be apparent to those of skill in the art upon studying the above description and are intended to be embraced therein. Therefore, the scope of the present disclosure is defined by the appended claims, and all devices, processes, and methods that come within the meaning of the claims, either literally or by equivalence, are intended to be embraced therein. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A snow thrower impeller assembly positioned within an impeller housing that defines an interior wall thereof, said snow thrower impeller assembly comprising:

a hub rotatable about a central axis of rotation;

a back plate attached to said hub, said back plate defining an outer circumference;

a plurality of blades attached to said hub and extending in a radially direction therefrom;

at least one mounting slot formed in each of said plurality of blades;

a wiper positioned adjacent to a leading face or a trailing face of at least one of said plurality of blades, said wiper comprising a pair of opposing wiper portions, wherein one of said wiper portions is received within one of said at least one mounting slot to mount said wiper to said impeller without a fastener;

wherein said wiper contacts said interior wall of said impeller housing during rotation of said hub to limit a gap between said blades and said interior wall; and at least one lower mounting slot formed into said back plate adjacent to each of said blades, wherein another of said wiper portions of each wiper is received within one of said lower mounting slots.

2. The snow thrower impeller assembly of claim 1, wherein each of said at least one mounting slot has a slot length, and each of said wiper portions has a wiper length, said wiper length is smaller than said slot length.

3. The snow thrower impeller assembly of claim 2, wherein said at least one mounting slot is oriented radially to allow said wiper to slide radially relative to said corresponding blade.

4. The snow thrower impeller assembly of claim 1, wherein said wiper is formed of a flexible material.

5. The snow thrower impeller assembly of claim 4, wherein said wiper is formed of a fabric layer sandwiched within a rubber compound.

6. The snow thrower impeller assembly of claim 1, wherein each of said lower mounting slots has a slot length, and each of said wiper portions has a wiper length, said wiper length is smaller than said slot length.

7. The snow thrower impeller assembly of claim 1, wherein said at least one lower mounting slot is positioned adjacent to said leading face of each of said plurality of blades.

8. A snow thrower impeller assembly positioned within an impeller housing that defines an interior wall thereof, said snow thrower impeller assembly comprising:

a hub rotatable about a central axis of rotation;

a back plate attached to said hub, said back plate defining an outer circumference;

a plurality of blades attached to said hub and extending in a radially direction therefrom, each of said blades includes a first blade portion attached to said hub and a second blade portion extending from said first blade portion toward said outer circumference, and a blade extension extends upwardly and at a forward angle from said second blade portion;

an upper mounting slot formed in said blade extension of each of said plurality of blades, and a lower mounting slot formed in said back plate adjacent to a leading face of each of said blades;

a wiper mounted adjacent to said leading face of each of said blades, said wiper comprising a pair of opposing wiper portions, wherein one of said wiper portions is received within one of said upper mounting slots and the other of said wiper portions is received within the opposing lower mounting slot to mount said wiper adjacent to said leading face of said blade without a fastener, wherein each of said wipers is axially slidable relative to said blade for limiting a gap between said blades and said interior wall of said impeller housing.

9. The snow thrower impeller assembly of claim 8, wherein each of said upper and lower mounting slots has a slot length, and said pair of wiper portions of each of said wipers has a wiper length, said slot lengths are larger than said wiper lengths to allow said wiper portions to slide within said upper and lower mounting slots.

10. The snow thrower impeller assembly of claim 8, wherein said upper and lower mounting slots are radially oriented.

11. The snow thrower impeller assembly of claim 8, wherein said wiper is formed of a flexible material.

12. The snow thrower impeller assembly of claim 11, wherein said wiper is formed of a fabric layer sandwiched within a rubber compound.

* * * * *